United States Patent [19]

Caspi et al.

[11] 3,983,370

[45] Sept. 28, 1976

[54] TEXTILE MACHINE CONTROLLER

[75] Inventors: Amiram Caspi; Michael N. Kahn, both of Tel-Aviv, Israel

[73] Assignee: Sci-Tex Corporation Ltd., Herzlia "B", Israel

[22] Filed: May 22, 1975

[21] Appl. No.: 580,397

Related U.S. Application Data

[63] Continuation of Ser. No. 352,863, April 20, 1973, abandoned.

[52] U.S. Cl. ..... 235/151.1; 340/172.5; 66/154 A; 66/50 R

[51] Int. Cl.[2] ..... D04B 15/78

[58] Field of Search ..... 66/50 R, 25, 154 A, 66/75; 235/151.1

*Primary Examiner*—Eugene G. Botz
*Attorney, Agent, or Firm*—Cesari and McKenna

[57] ABSTRACT

A controller for instructing a knitting machine or the like to make a patterned fabric stores data representing stitch types comprising a subpart of the pattern. The controller determines the location of each stitch on the fabric and relates each such stitch to an equivalent location on the pattern subpart. Data representing the stitch type for the equivalent location is retrieved and instructions issued based thereon which cause the machine to form the retrieved stitch type at the determined location.

12 Claims, 10 Drawing Figures

TEXTILE MACHINE CONTROLLER

This is a continuation of application Ser. No. 352,863 filed 4/20/73, now abandoned.

BACKGROUND OF THE INVENTION

This invention relates to a controller for a textile machine. It relates more particularly to a controller capable of generating instructions for most conventional circular knitting machines to cause the machines to knit fabrics in accordance with preselected patterns.

The knitting machines with which we are concerned here are equipped with individually operable needles or other appropriate knitting instruments and means for exercising selective and individual control over these instruments according to predetermined patterning requirements. Since the general construction and operation of the knitting machines to which the present invention is applicable are well-known and familiar to those conversant with the knitting art and as the invention is entirely concerned with an improved means of needle selection, we shall not describe the knitting machine per se except as necessary to clarify the operation of the subject controller.

Suffice it to say at this point that the machine includes yarn feeders with electromagnetic needle selectors which are energized or not in a predetermined manner to knit the preselected patterned fabric. Such knitting machines are described in some detail in U.S. Pat. Nos. 1,927,016; 3,313,128; 3,449,928. Both the fabric and a set of knitting needles are rotated past a circular array of yarn feeders. A needle selector at each feeder is controlled in synchronism with fabric movement to produce given stitch colors or types at given locations on the fabric in accordance with the desired pattern.

In the electronic knitting machines with which we are primarily concerned here, the selectors at the feeders are solenoid-operated and electronically controlled by means of a controller. Controllers as such are not new, an example of one being disclosed in British Patent No. 1,278,304. They are programmed from a tape or film and simply execute instructions for actuating the selectors at the appropriate times to generate the desired fabric patterns. The instructions are retrieved from a punched tape or other such recording medium.

Conventional controllers, however, are not entirely satisfactory for controlling the large, high-speed knitting machines which are coming into widespread use at the present time. In the first place, their capacity is limited, which places corresponding constraints on the size and complexity of the basic patterns which they can instruct the machine to knit. Also, in many cases, the instructions which they are able to deliver permit the associated knitting machine to knit only a square basic pattern, i.e. a pattern composed of an equal number of columns and rows of stitches.

Conventional controllers are disadvantaged also in that, once set up to deliver instructions for knitting a certain basic pattern, they cannot easily be adjusted to instruct an associated knitting machine to knit a different pattern or a variation of the original pattern; they must obtain instructions from a different tape. Moreover, with conventional controllers, it is relatively difficult to change the colors in the basic pattern; either new detailed instuctions must be entered on the control tape, or multiple tapes used, or the colors of the yarns at the various knitting machine feeders have to be changed. In each case, the system must be shut down for a relatively long time, resulting in a drop in productivity.

SUMMARY OF THE INVENTION

Accordingly, it is an object of the present invention to provide a textile machine controller for generating knitting instructions which has a high degree of flexibility in terms of the textile pattern which it can create.

Another object of the invention is to provide a knitting machine controller which itself can easily be controlled to effect changes in the knitted pattern.

Yet another object of the invention is to provide a knitting machine controller which can direct the machine to knit a wide variety of patterned fabrics.

A further object of the invention is to provide a knitting machine controller which can direct a knitting machine to knit basic patterns having many different shapes and sizes.

Still another object of the invention is to provide a relatively low cost knitting machine controller which can generate operating instructions for most conventional electrically controlled circular knitting machines.

Yet another object is to provide a controller of this type which is relatively inexpensive to manufacture.

Still another object is to provide a controller which is easy to operate.

Other objects will in part be obvious and will in part appear hereinafter.

The invention accordingly comprises the features of construction, combination of elements and arrangement of parts which will be exemplified in the construction hereinafter set forth and the scope of the invention will be indicated in the claims.

Briefly, the present controller employs a random access memory which stores the color information as a binary code and the stitch locations on the fabric define the memory addresses of the respective items of color information. The controller operates in synchronism with the knitting machine. As the knitting machine increments from one needle position to the next, the coded color information is extracted from the corresponding memory locations and the required control signals are routed to the various feeders to cause the knitting machine to knit in accordance with the stored information.

More specifically, most textile patterns are composed of a basic pattern which repeats itself in some way either vertically or horizontally or in both directions on the fabric. The present controller takes advantage of this by storing in the memory essentially only the basic pattern plus the repeat information. The memory can therefore be of relatively modest capacity. As the knitting operation increments to each successive needle position, the controller automatically determines the location of each feeder on the fabric. Then it determines the equivalent location of that feeder on the basic pattern being knitted. Then it determines whether or not that particular feeder has been selected to knit at that location. If it has, the selector for that feeder is energized; if it has not, the selector is not so energized.

This procedure is carried out each time the machine moves to a new needle position with the result that the machine knits fabric continuously with the desired basic pattern and repeat format.

The controller can be adjusted quite easily to change the pattern color format simply by changing a feeder selection table in the controller so that where a blue feeder, for example, was originally supposed to knit, a red feeder now knits. The knitting machine does not have to be altered in any way to accomplish this. Similarly, the pattern repeat format can be altered whenever desired by front panel controls on the controller without having to modify the knitting machine or changing the information stored in the memory.

BRIEF DESCRIPTION OF THE DRAWINGS

For a further understanding of the nature and objects of the invention, reference should be had to the following detailed description taken in connection with the accompanying drawings, in which.

DESCRIPTION OF THE PREFERRED EMBODIMENT

Figure 1:
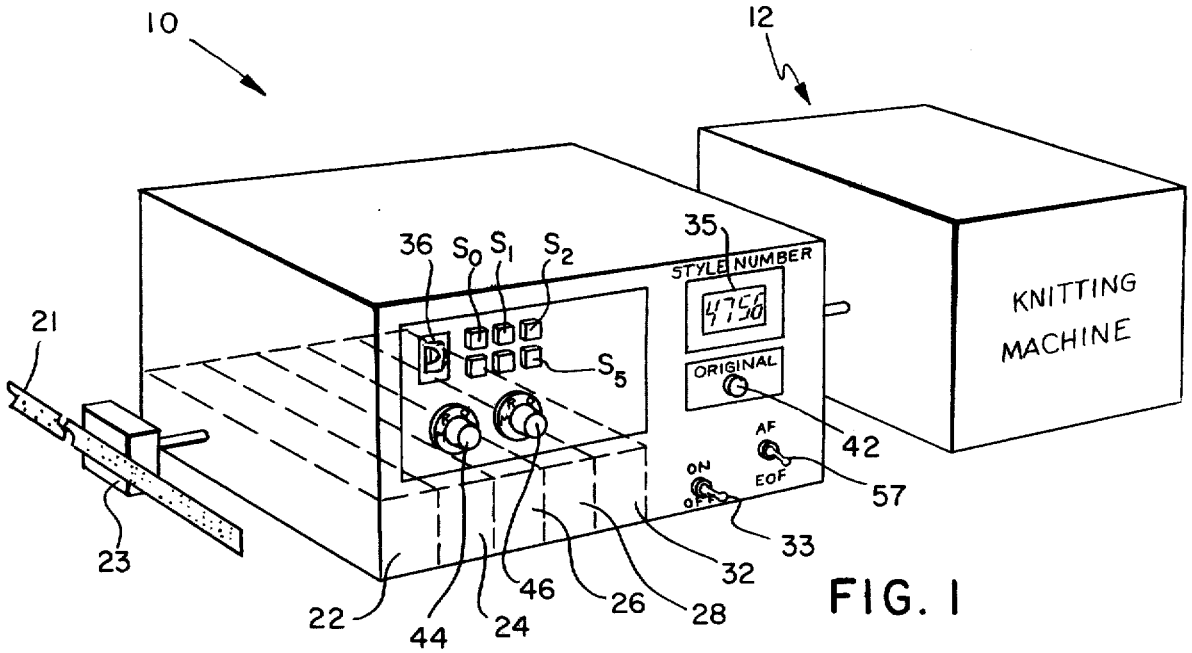
FIG. 1 is a diagrammatic view of the subject controller and an associated knitting machine.

Turning now to FIG. 1 of the drawings, the present controller, shown generally at 10, is connected to control a conventional circular knitting machine shown generally at 12. The knitting machine may, for example, be any electronically controlled circular knitting machine. For purposes of illustration, we will describe the controller as controlling a 36-feed knitting machine knitting a pattern comprised of six colors. In other words, there are six groups of six feeders working on six successive helical courses in the fabric.

Figure 2A:
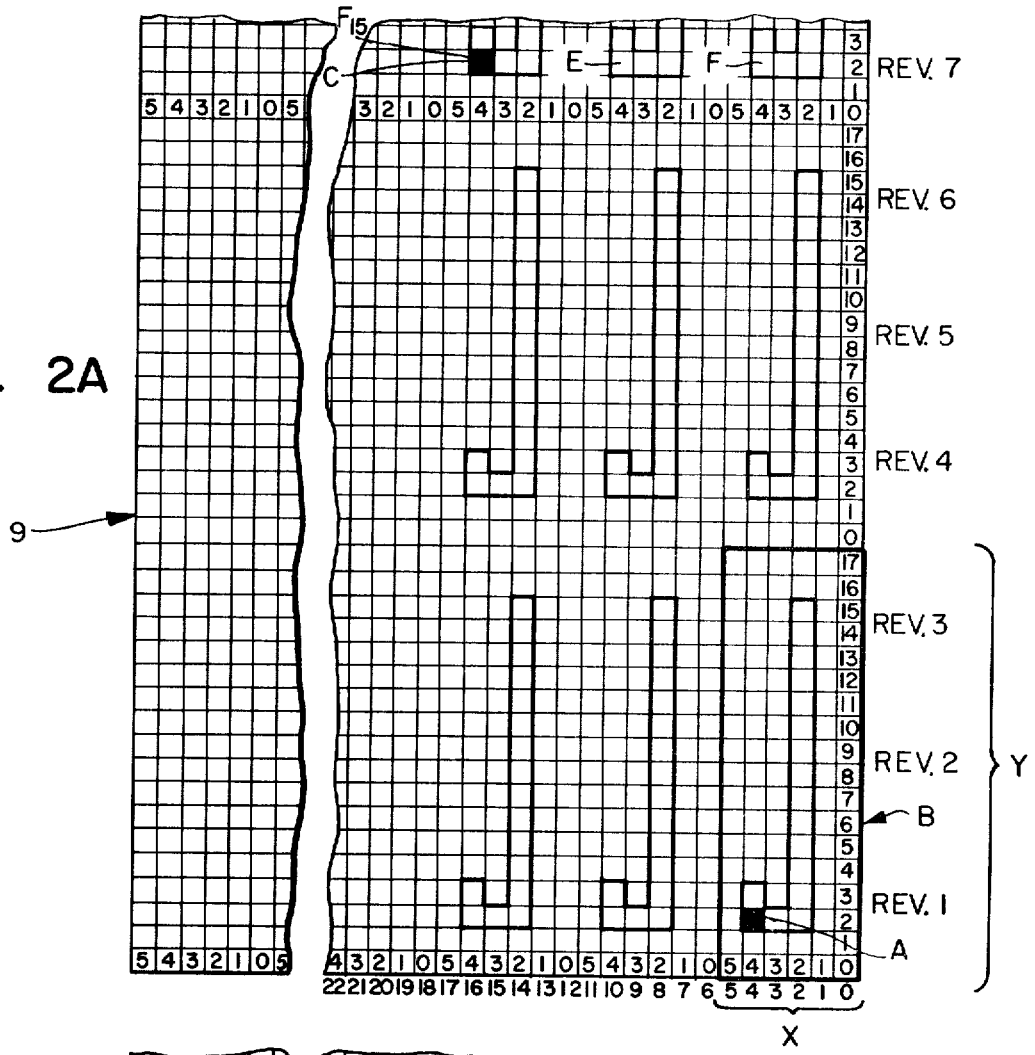
FIG. 2A is a diagrammatic view of a grid bearing a pattern having a normal repeat which is intended to be knitted into a fabric.
Figure 2B:
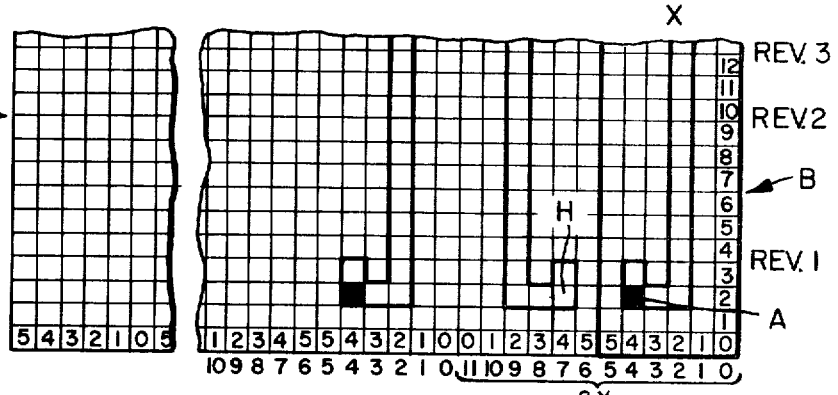
FIG. 2B is a similar view showing a pattern which is repeated in a mirror image format.
Figure 2C:
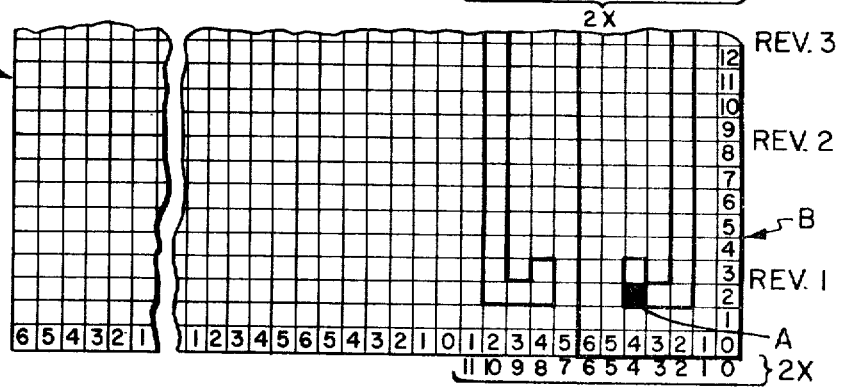
FIG. 2C is a similar view showing a pattern which is repeated in a chevron or modified mirror image format.

When setting up the machine 12 to knit a particular pattern, the usual procedure is first to draw the pattern on a grid, with each square in the grid representing a stitch in the pattern. FIGS. 2A, 2B and 2C illustrate grids 9 such as this. The FIG. 2A grid carries a basic pattern outlined at B which is 18 rows or courses high (i.e. from Y =0 to Y =17) and six columns or wales wide (i.e. from X =0 to X =5). Each square in the grid corresponds to a stitch in the knitted fabric. The basic pattern is repeated in the X and Y directions over the rest of the grid. FIG. 2B illustrates a grid 9 with the same basic pattern B. However, the pattern B is repeated in the X direction in a mirror image fashion so that its X coordinate increases from X =0 to X =5 and then decreases from X =5 to X =0. Finally, FIG. 2C shows another modification using the same basic pattern wherein the pattern is repeated in the X direction in what is known as a chevron format. This is a mirror image of the basic pattern, but with the row bordering the basic pattern omitted. In other words, the pattern is one column wider than the mirror repeat, the X coordinate going from X =0 to X =6 and down again to X =0. Of course, the pattern might also repeat in a mirror or chevron format in the vertical or Y direction.

Still referring to FIG. 1, controller 10 includes a memory section 22 which stores information read into it by a tape reader 23 from a punched tape 21. Section 22 stores in a binary code the color of each square in the grid 9.

The color data for each square consists of 2 or 3 bits, depending upon whether the pattern includes four colors or up to six colors. The colors of successive squares in the pattern are stored in consecutive locations in the memory, starting from the bottom of column 0 of the basic pattern to the top thereof, from the bottom to the top of column 1, and so on through the last column on the left.

The memory section also stores certain parameters characteristic of the pattern being knitted. These parameters include the color selected for each feeder; the identity of any unused feeders, the width (X) and height (Y) of the basic pattern, the number of colors in the pattern, etc. These parameters are stored as a block of words in the memory.

Also in the controller 10 are an X address generator section 24 and a Y address generator section 26. The purpose of the generator sections 24 and 26 is to locate each particular feeder relative to the pattern on the fabric and then relate the location to an equivalent location on the basic pattern, since only basic pattern information is stored in memory section 22. Finally, sections 24 and 26 transform the coordinates of each feeder location in the basic pattern into a memory address which corresponds to that location so that the proper color data for the fabric stitch corresponding to that location is read out of the memory. The controller 10 also has a control section 28 which develops various timing and control signals so that the controller performs its functions in the correct sequence. Finally, there is an interface section 32 where certain parameters are wired into the controller. Its circuitry varies with the particular knitting machine 12 being controlled. In other words, different knitting machines may have different characteristics. For example, the number of feeders may vary, also the number of needles between feeders may vary.

The interface section 32 is designed to accommodate the output signals from the controller to the particular knitting machine being controlled.

Still referring to FIG. 1, although the basic pattern information is stored in the memory section 22, in some instances, one may want to change the overall pattern during the knitting operation. For example, one may want to switch some of the colors in the basic pattern or change the pattern repeat format. The present system includes certain front panel controls which permit this and whose specific operation will be described in more detail later. Suffice it to say at this point that there is a thumb wheel switch 36 having a number of positions designated A to F assigned to colors stored in memory. For example, as depicted in FIG. 1, switch 36 is set at letter D corresponding to color codes (assigned to green, for example). Also, there are six pushbutton switches numbered $S_0$ to $S_5$ corresponding to six feeders, the maximum number that may be in a course. If one wishes feeder 4 to knit green instead of red for which the system was originally programmed, one sets switch 36 on the letter D and depresses switch $S_3$ corresponding to the fourth feeder. This changes the feeder selection table in the controller so that feeder 4 now knits green. Subsequently, if it is desired to have feeder 4 knit the color originally programmed into the controller from the tape 21, one simply presses an ORIGINAL (O) button 42 which will restore the original selection table.

There are also two front panel control switches 44 and 46 by which the operator can change the repeat instructions for which the controller was originally programmed. For example, assume that instructions from the tape 21 caused knitting machine 12 to knit a pattern with a standard repeat in the height and width directions of the type shown in FIG. 2A. One can turn switch 44 from its ORIGINAL (O) setting to its MIRROR (M) setting and thereby change the instructions to machine 12 so that it knits a pattern with a mirror repeat in the horizontal direction such as depicted in FIG. 2B. A further adjustment of the knob to its CHEVRON (C) setting produces a chevron repeat as depicted in FIG. 2C. Similar adjustments to switch 46 produce the same repeat change in the vertical direction.

Other front panel controls include a power switch 33 and a digital display 35 which shows the style number assigned to the particular basic pattern loaded into the controller. This information is stored in the memory and used to control the display. Also a three-position switch 57 is included by which the operator can select a normal knitting sequence (N), an all feeders knit sequence (AF) or an every other feeder knit sequence (EOF), the latter two positions being used to test the machine 12.

The controller 10 operates in sychronism with the knitting machine. Each time the machine increments one needle space, i.e. brings a new stitch position in the fabric into each of the feeder locations, the controller determines for each feeder whether or not a stitch should be made at that location. In order to do this, the controller determines the location of each particular feeder on the fabric being knitted. Once the location of a feeder on the fabric is determined, the controller computes the equivalent location or coordinate of that feeder in the basic pattern, i.e. the corresponding square in the pattern grid. The third step is to perform a linear transformation of the pattern coordinates to obtain the memory address of the color information pertaining to that specific stitch.

Assume, for example, that the spot or stitch should be in accordance with color code 1 (e.g. red). In that case, the controller will retrieve from the memory a byte denoting the color code 1. If the particular feeder in question is feeding code 1 yarn, then it will be instructed to knit. If that particular feeder is handling yarn corresponding to some other color code, then it is instructed not to knit.

Thus, after the knitting machine has completed one revolution past that feeder, every stitch in the particular course on which that feeder was working which is supposed to be the code 1 color will have been knit.

The same procedure is followed with all of the other feeders in the knitting machine. Each time the machine is stepped, the location of each feeder on the fabric is determined. Then the equivalent location of that feeder on the basic pattern is found, and finally, a linear transformation of that location is made in order to properly address the memory to obtain the color code for that particular spot or stitch. Then the feeders are all caused to knit or not knit, following which the knitting machine steps into the next needle position and the cycle is repeated to determine which feeders are to knit at their new needle locations.

To conserve memory capacity, we generally store therein only the basic pattern but once, rather than repeating it in the memory as it is to be repeated on the fabric. When a feeder reaches a position on the fabric outside the basic pattern, it is in an area where the pattern is repeated. The controller therefore computes for that feeder position the corresponding stitch in the basic pattern and instructs the feeder to knit or not to knit according to the color code stored in the memory location associated with the basic pattern stitch.

To illustrate the operation of the controller, we will first describe the general techniques used to locate the position of the feeder on the fabric and to generate the memory address for retrieving from memory the information identifying the color code for that particlar location and for determinting whether or not the feeder at that location should knit.

The pattern depicted in FIG. 2A is comprised of six colors so that six courses or rows are knitted for each revolution in the knitting machine. Also, the basic pattern depicted there is three machine revolutions high. Thus, one basic pattern consists of 18 rows numbered 0 to 17 and six columns numbered 0 to 5. Thus, with this setup, the machine can only knit in the Y direction up to row 17; then it must start the pattern over again at row 0. The machine can knit a basic pattern in the X direction up to thousands of colums wide depending on the number of cylinder needles in the machine. But, in any event, the pattern starts over again at X=0, Y=0 every three machine revolutions so that corresponding stitches in all of the patterns in columns 0 to 5 have the same stitch coordinates.

For a pattern composed of regular repeats of the basic pattern, two situations can arise. In one, the feeder of interest is located inside the basic pattern, say, at point A. In the second situation, the feeder is located outside the basic pattern, on a repeat thereof, say at point C. We will treat both of these situations in a conceptual fashion.

The controller memory stores the color information for each stitch location in the basic pattern, i.e. including stitch A. In the first example, then, the controller first determines the X and Y coordinates of stitch A, i.e. X=4, Y=2. Next, the controller converts these coordinates into a memory address that will retrieve the color data for that particular stitch A. This is necessary because the stitch color information for the basic pattern is not stored in the memory in the order in which those stitches are knitted. Rather, as mentioned previously, the colors for the bottom stitch in column 0 through successive columns to the top stitch in column 5 are stored as consecutive bytes in the controller memory.

Accordingly, the controller, following the same path, determines the number of stitches from the bottom stitch in column 0 to stitch A, to wit: 74 stitches. The system then counts to memory address 74 and the byte pertaining to stitch A is retrieved from memory. If the feeder at location A is the one set up to knit that color, then an instruction is issued causing that feeder to knit. On the other hand, if the feeder at location A is not set up to knit the color retrieved from memory, it will not knit there. Rather, the controller will instruct a different feeder to knit stitch A at another point in the knitting sequence.

In the second example concerning a feeder at location C outside the basic pattern, the first step is to find the location of the feeder on the fabric, i.e. determine the X and Y coordinates of stitch C. Then, the system must convert this information to an equivalent stitch in the basic pattern, since the controller memory only stores the color of stitches in the basic pattern. This is accomplished by stepping backwards from location C to the basic pattern (and, more accurately, to a repeat directly above the basic pattern having the same stitch coordinates as the basic pattern) in steps which are at first a large multiple of and then equal to the basic pattern width until the corresponding point is reached in the basic pattern, i.e. stitch A. The system then converts these coordinates to a memory address exactly as was done above in the first example and, in fact, the same color information is retrieved from memory since stitches A and C are corresponding points in the pattern.

If the pattern being knitted is comprised of mirror image repeats of the basic pattern, the above described conversion of the feeder location to an equivalent location on the basic patern must be modified to some extent. This is because only every other repeat in the width and/or height directions are duplicates of or correspond stitch-by-stitch to the basic pattern. In other words, in effect, the size of the basic pattern is doubled in the direction of the mirror or chevron repeat.

Thus, in the case of a mirror repeat in the X direction, the system steps back from the location of the feeder of interest in even multiples of the basic pattern width until it reaches the basic pattern (which includes the real basic pattern plus the first mirror repeat thereof). If a point on the real basic pattern is reached, say, point A in FIG. 2B, that is the equivalent location in the basic pattern of the feeder of interest. On the other hand, if a point on the mirror repeat extension of the basic pattern is reached, say, point H, there is additional processing to reach the equivalent location A on the real basic pattern.

Similarly, for a mirror or chevron repeat in the Y direction, the basic pattern height is considered as doubled so that it is comprised of the real basic pattern plus the first repeat in the Y direction. When converting the Y coordinate of the feeder of interest to a location on the basic pattern, then, either a point on the rear basic pattern is reached, in which case it is indeed the equivalent of the feeder location, or a point on the extended basic pattern, i.e. the first repeat in the Y direction, is reached, in which case, that coordinate is further processed to an equivalent coordinate on the real basic pattern. Following this, the coordinates in the real basic pattern are converted to an equivalent memory address as was done with the regular repeat.

To implement the above steps, the controller locates the X coordinate of the feeder of interest, i.e. feeder 15, on the fabric by counting the number of needles between an index feeder and an index needle and then subtracting the number of needles between the feeder 15 and the index feeder, which difference equals the number of stitches between the feeder 15 and the index needle. In this example of FIG. 2A, the number is +16. However, if this happens to be a negative number, indicating that the feeder of interest is actually knitting in a previous revolution from the index feeder, the number is increased by the number of needles in the machine to obtain the proper X coordinate of the feeder of interest.

At the same time, the controller computes the Y coordinate of the feeder of interest on the fabric by counting the number of courses on the fabric between the feeder 15 and the index feeder. In this case, the number is +2. However, if the feeder 15 is knitting in a previous revolution from the index feeder, then that course number is reduced by the number of courses per revolution to reach the Y coordinate of the feeder of interest.

Following this, the controller converts these coordinates (16,2) to equivalent coordinates on the basic pattern by stepping backwards in the X direction to the basic pattern as described above. In this example, the stepping process yields coordinates 4,2, i.e. point A on the basic pattern B.

In some cases, the aforesaid deduction of the number of courses per revolution from the course number results in a negative number indicating that the coordinates are still outside the basic pattern. In this event, that negative number is augmented by the number of courses in the basic pattern to obtain the equivalent Y coordinate of the feeder of interest in the basic pattern.

In the case of the mirror or chevron repeat, the aforesaid further processing of a computed position on the extended basic pattern is accomplished by a twos complement subtraction operation which yields the correct equivalent X and Y coordinates of the feeder of interest on the real basic pattern.

The controller then performs a linear transformation on these coordinates, to wit: the Y coordinate plus the product of Y and the X coordinates, in order to obtain the correct memory address which will retrieve the color information pertaining to that point on the basic pattern. In this case, the transformation yields the number 74 and the color code retrieved from memory address 74 (which corresponds to the 75th stitch in the basic pattern since the first stitch is at address 00) is then compared with the color code for which the feeder 15 was set up to knit. If there is a match, the feeder knits. If there is no such match, then the feeder does not knit.

All feeders are processed in the foregoing manner each time the knitting machine steps to a new needle position. Consequently, the controller continuously controls the knitting process to generate the desired patterned fabric.

At this point a brief word on the organization of the diagrams will aid in comprehending the nature and operation of the various circuits used in the controller. Basically the controller is a special purpose computer with various registers, address, counters and comparators interconnected to determine the memory locations corresponding to feeder positions in accordance with a fixed overall scheme. Operational details, however, may be varied according to the contents of a control register that contains the variable pattern parameters other than color. Further variations may be entered into the controller from the front panel as described above.

Figure 7:
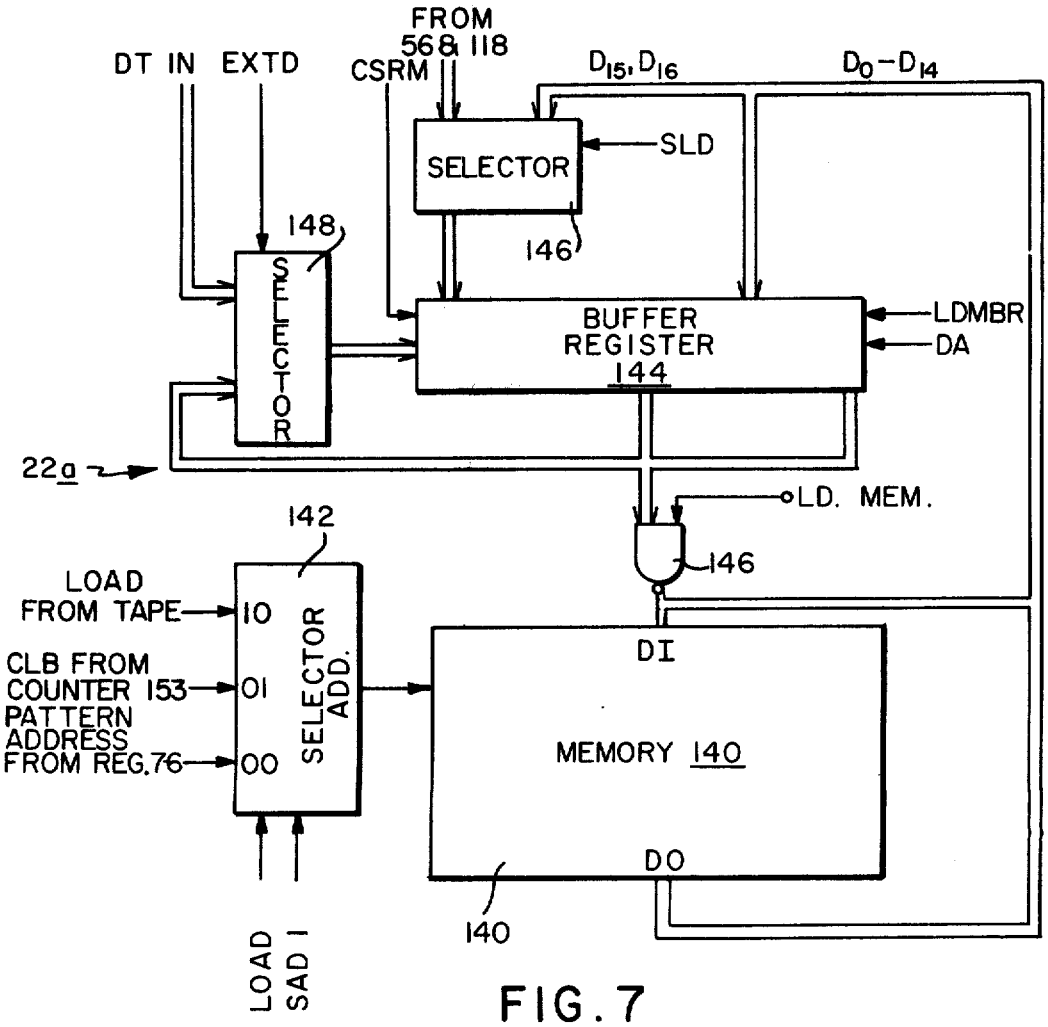
FIG. 7 is a block diagram of the memory data input section of the controller.
Figure 3:
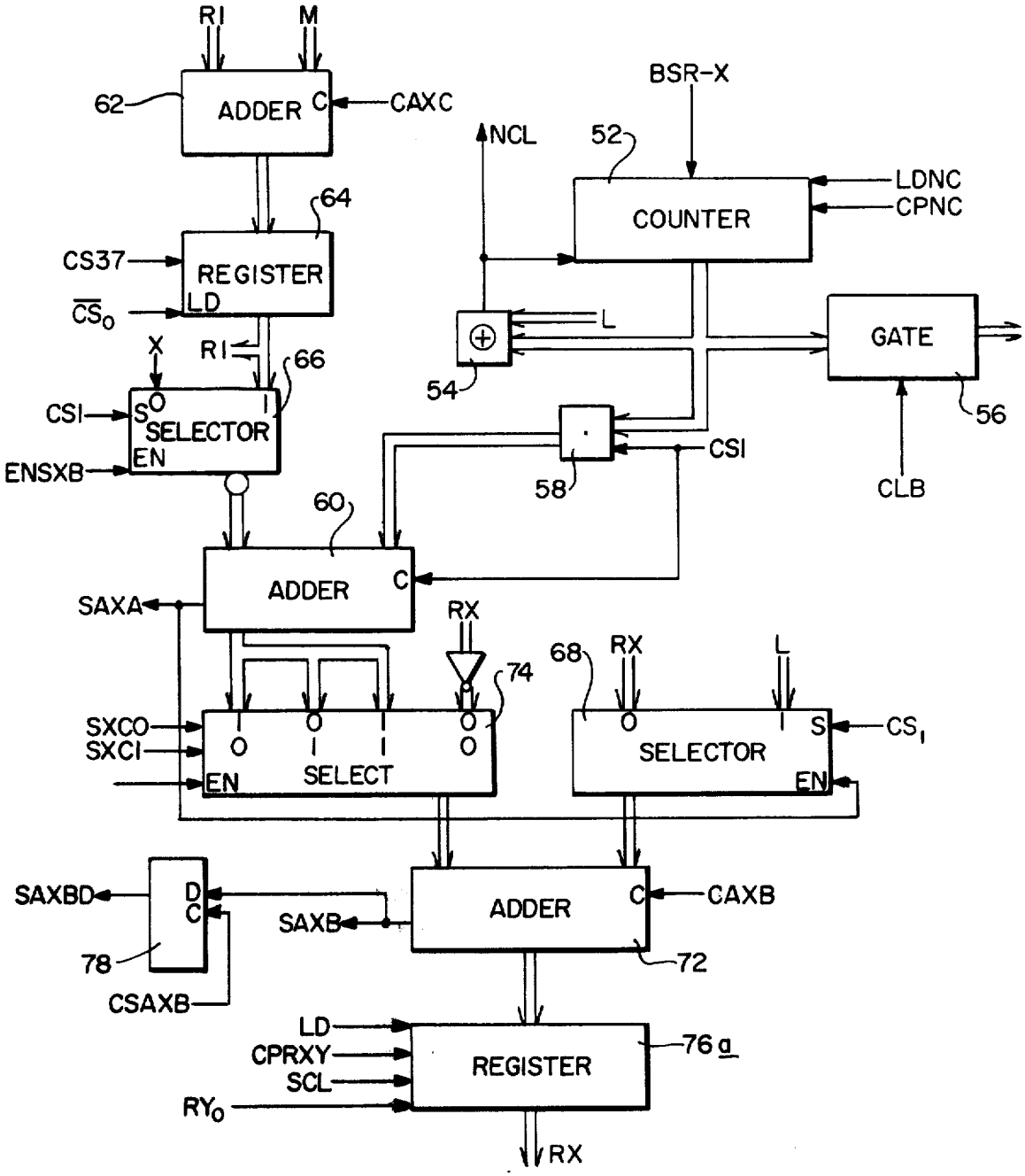
FIG. 3 is a block diagram of the X address generator section of the FIG. 1 controller.
Figure 4:
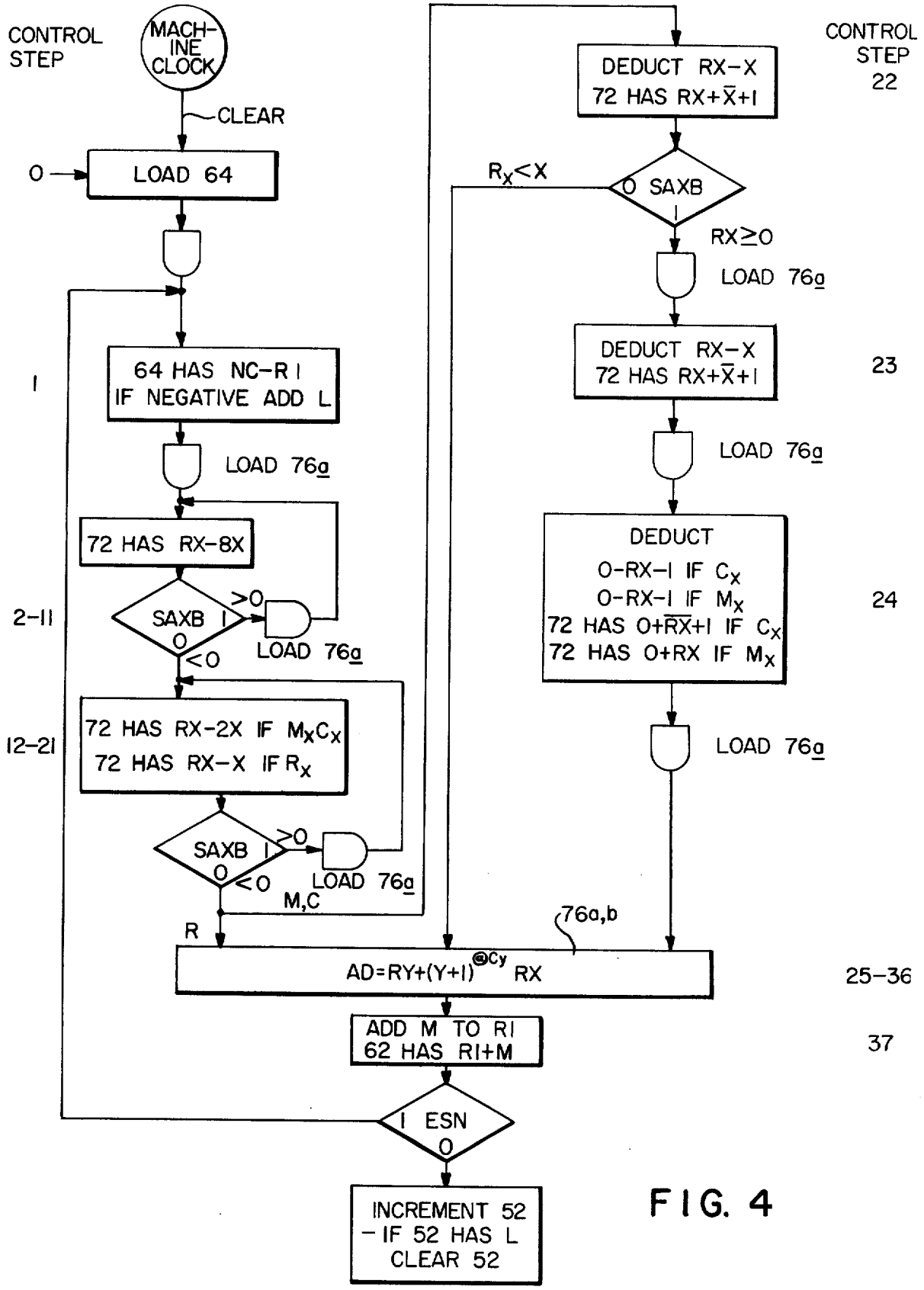
FIG. 4 is a flow diagram illustrating the operation of the FIG. 3 section.
Figure 5:
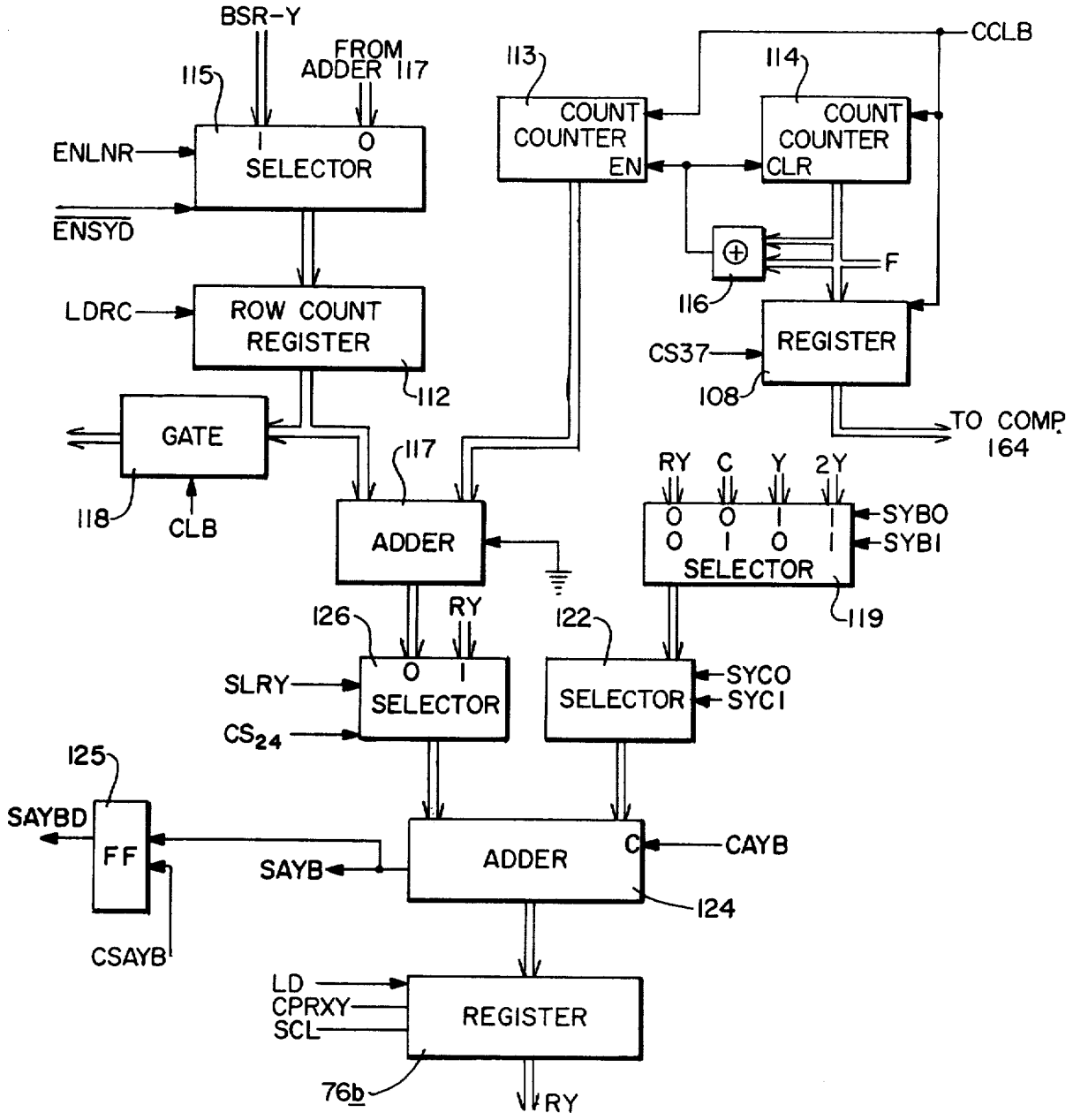
FIG. 5 is a view similar to FIG. 3 of the Y address generator section of the FIG. 1 controller.
Figure 6:
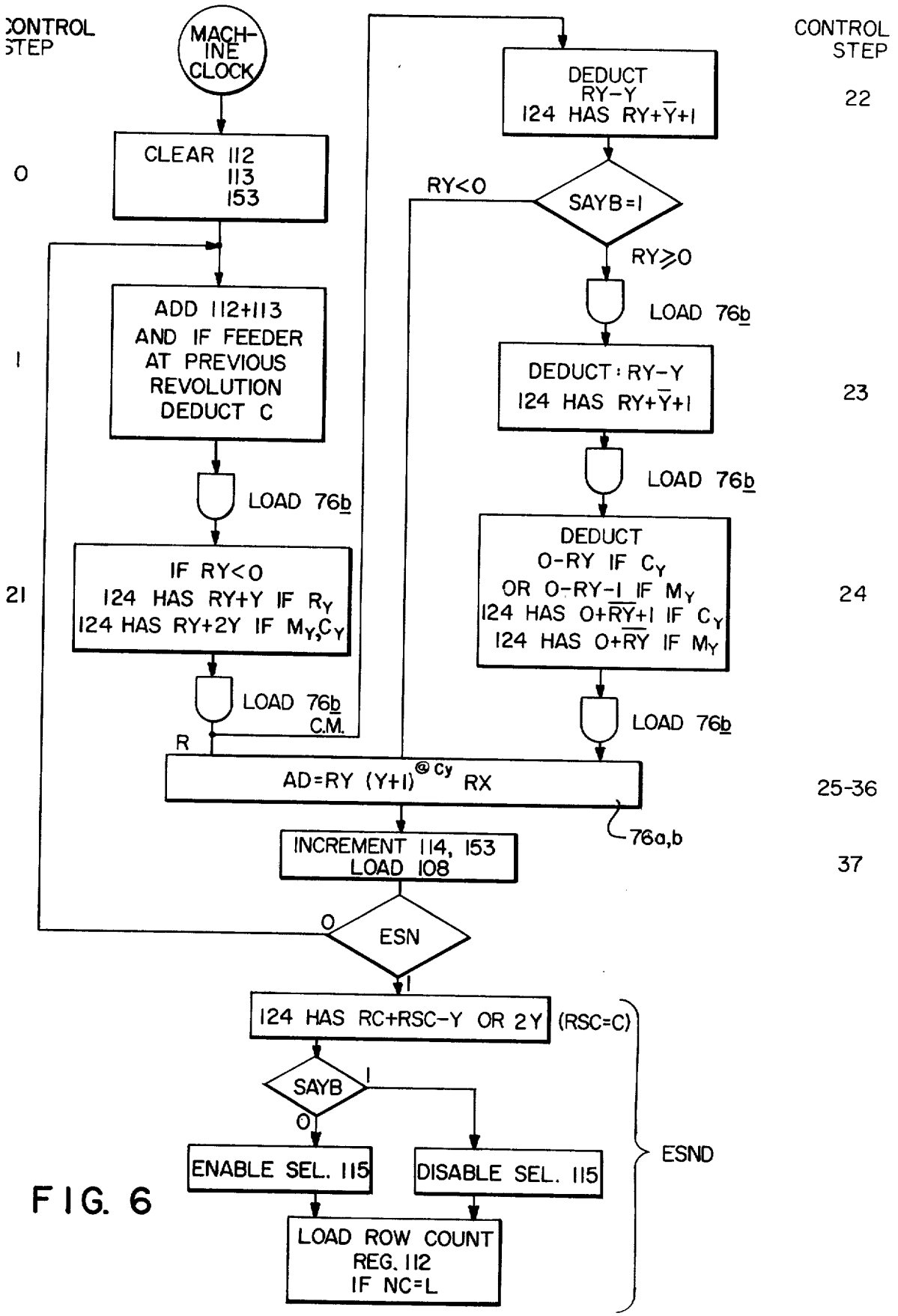
FIG. 6 is a flow diagram of the FIG. 5 section.
Figure 8:
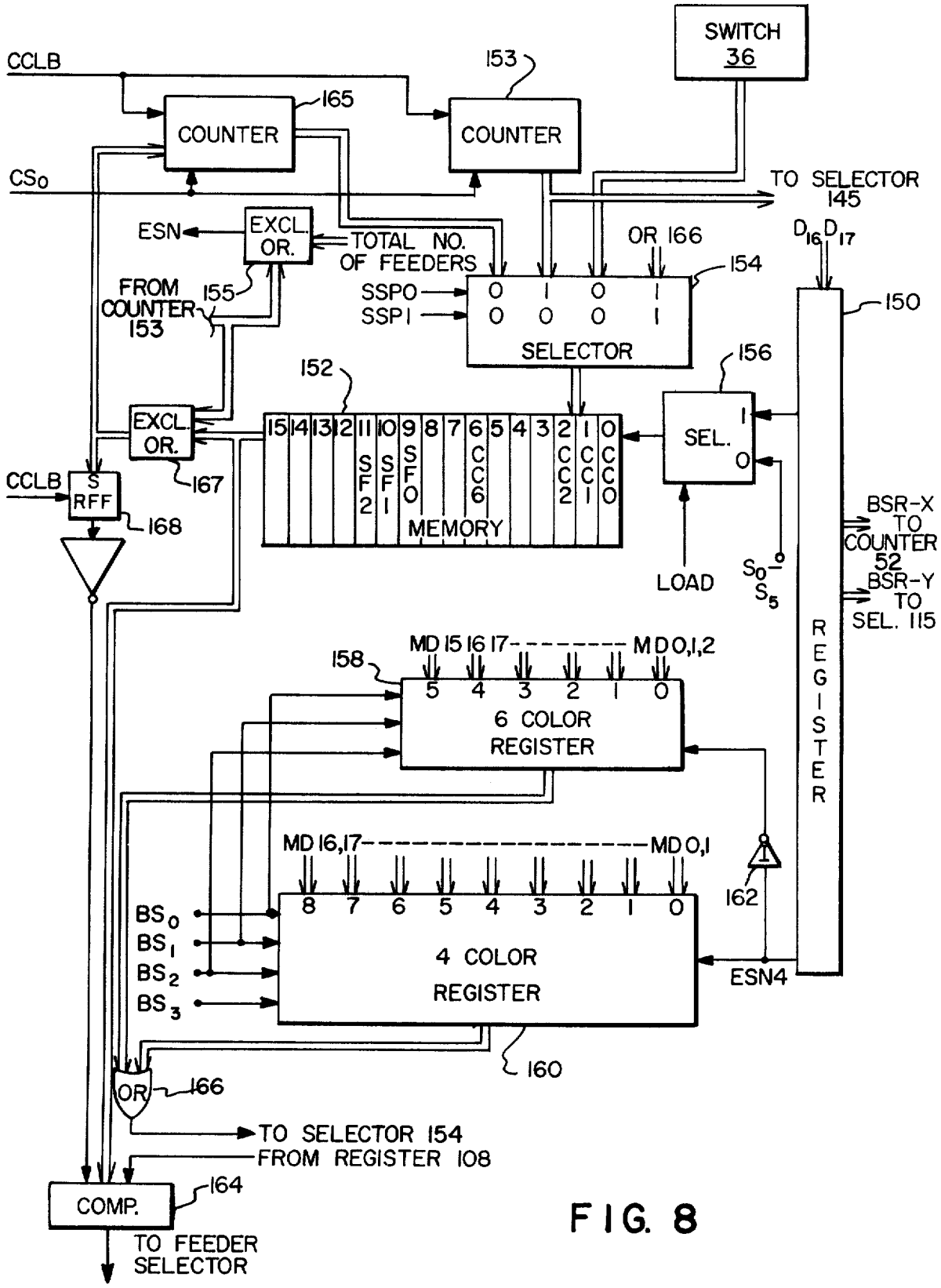
FIG. 8 is a block diagram of the memory data output section thereof.

FIGS. 4 and 6 are flow charts showing how the controller computes the portions of each memory address corresponding to the horizontal and vertical positions of each feeder on the fabric. FIGS. 3 and 5 depict registers, adders, etc. used in computing the address portions and the interconnection of these circuit elements for data flow. These latter figures also show control signal inputs for the data handling elements. FIGS. 7 and 8 provide the same information with regard to the organization of the memory section and the ultimate determination of whether or not each feeder is to knit at its present location.

We have not included detailed diagrams of the timing and decision circuitry. The timing scheme for computation is shown in the flow charts (FIGS. 4 and 6) and the gating of various timing and control signals developed by section 28 in accordance with the program is a straightforward arrangement well-known to those skilled in the art. Suffice it to say that the controller operates in accordance with an internal clock that runs through a series of cycles each time the knitting machine indexes to its next needle position.

Certain elements termed "selectors" are preferably matrix switches which select according to binary coded signals as shown at the tops of the corresponding boxes in the drawings. Data is passed through a selector upon occurrence of the designated enable (EN) signal shown in each case. Each adder provides its adding function upon occurrence of a carry signal applied thereto at a terminal "*c*". Data is loaded into a register or counter by a load (LD) signed as shown.

As an example of controller operation, assume the knitting machine is knitting in accordance with the pattern grid 9 in FIG. 2A. The basic pattern outlined at B, is six columns wide and 18 rows high and is comprised of stitches in six colors, i.e. red (R), blue (B), green (G), etc. While FIG. 2A is a pattern grid, it also accurately reflects the pattern actually knitted into the fabric, with each square representing a stitch in the fabric. This means that with six courses per machine revolution, the pattern is three revolutions high.

Assume further that at a given instant in time during the knitting operation, a feeder (No.15) is positioned on the fabric at point C, which is outside the basic pattern B but in a repeat thereof. We shall now describe the construction and operation of the controller in connection with its determination of whether or not feeder 15 should stitch at point C. This is accomplished in a series of up to 38 steps controlled by up to 38 timing signals CSO to CS37. As a first step the address generator sections 24 and 26 locate exactly where feeder 15 is on the fabric, i.e. they determine the coordinates of point C.

More particularly, referring jointly to FIGS. 3 and 4, the X section 24 includes a needle counter 52 which operates in synchronism with the knitting machine 12 clock. The counter 52 has the count of zero (0) when feeder zero (0) is located directly opposite a missing needle on the machine 12. This missing needle position serves as an index and it is designated needle zero (0) or "slit line". The counter 52 is incremented by clock pulses CPNC derived from needle indexing in the knitting machine, so that its count (NC) reflects the number of needles between feeder O and needle O.

The output of counter 52 is applied to an EXCLUSIVE OR circuit 54. Another input to OR circuit 54 is the number of needles (L) in the particular machine 12 being controlled. This is one of the machine parameters that is normally wired into a connector (not shown) plugged into the X address section 24. Ech time the count in counter 52 equals the L, an output from circuit 54 resets the counter, indicating that the machine 12 has made a complete revolution and feeder O is again opposite needle O. (Actually, L is defined as the number of needles in the machine minus one since the first needle is defined as needle O.) The output of the counter 52 is also applied by way of a gate 56 to the memory section 22 where it is stored so that if there is a power failure, the count can be resumed after power returns.

Once having located the position of feeder O relative to needle O, the next step is to find the location of the feeder of interest, i.e. feeder 15, relative to needle O. This is accomplished by subtracting the number of needles between feeder 15 and feeder O from the needle position of feeder O. For this, the output of counter 52 is applied by way of a gate 58 to an adder 60. The contents of the counter are gated into adder 60 at control step 1 (CS1) which occurs at the beginning of the addressing sequence for each feeder.

The number of needles between the feeder of interest and feeder No. 0 is accumulated via an adder 62 in a register 64 whose content is designated RI. One input to the adder 62 is the number of needles (M) between the feeder of interest and the previous feeder. This number (M) is one of the parameters which is characteristic of the particular knitting machine being controlled. Its value may vary from machine to machine and, in fact, this number commonly varies between adjacent feeders in the same machine. The M's for successive feeders are hard-wired into the interface section 32 for each particular machine. During successive addressing sequences for the successive feeders, the M for the particular feeder is applied to adder 62. Since all of the feeders are handled in sequence, the M's are taken out in sequence. As each M is taken out, interface 32 indexes to the next M which is applied to adder 62 upon the occurrence of the next CS37 signal, and so on.

The value RI for any given addressing sequence is always equal to the sum of the M's up to and including the previous feeder. This value is stored in register 64 and applied to adder 62 at step 37 of the previous addressing sequence so it is always available at the beginning of the addressing sequence for the feeder in question. That is how the value RI is determined. Further with respect to the value M, in many machines the spacing between adjacent feeders is the same so that interface section 32 would contain a single number M which is applied to adder 62 for all addressing sequences.

The other input to the adder 62 is the number of needles between the previous feeder and feeder 0 and is designated RI. The contents of register 64 are applied to the adder 62 at control step 37 (CS 37) and register 64 is reset at CS 0.

Thus, at the beginning of each addressing sequence for each feeder immediately following CSO, the number of needles between the previous feeder and feeder 0 (RI) will have been cleared. Also, at the previous CS37 pulse, the value M for that feeder was applied to adder 62. Accordingly, immediately after CSO, the value RI+M is present in register 64. It follows from this that the value RI represents the sum of all of the M's up to but not including the feeder of interest. For example, at the beginning of the fifteenth addressing sequence relating to feeder No. 14, $RI=M_1+M_2+M_3+\ldots M_{14}$ and at time CSI, that number, plus $M_{15}$ is present in register 64 and loaded into adder 60.

At time CS1 the inverted contents of register 64 are applied to adder 60 by way of a selector 66. The selector is enabled by an ENSXB pulse from section 28 at time CS1. At the same time a gate 58 is enabled to apply the contents of counter 52 to adder 60 so that at control step 1 the adder 60 provides the quantity NC minus the number in register 64.

More specifically each time the knitting machine indexes, the register 64 is cleared. Then, during the first addressing sequence, which concerns feeder 0, RI is zero; the output of adder 62 is therefore M1. At control step CS 37, just prior to the beginning of the addressing sequence for feeder 1, the number of needles between feeder 0 and feeder 1, namely $M_1$, is applied to adder 62. Since register 64 is empty at this point, there is no other input to adder 62. Immediately after CS0, the output of adder 62 (i.e. M1) is present in register 64. Upon the occurrence of a CS1 signal, the needle count from counter 52 and the inverted number of needles $M_1$ between feeder 0 and feeder 1 from adder 62 are applied to adder 60. Consequently, the contents of that adder is the number of needles between feeder 0 and needle 0 less the number of needles between feeder 1 and feeder 0. At the end of the addressing sequence for feeder 1, at step 37, the contents of register 64 i.e. M, is applied to adder 62 along with the number of needles $M_2$ between feeder 1 and feeder 2. At the next step 1, M, $+M_2$ are applied to the adder 60 where it is subtracted from the new needle count NC loaded at CSI into adder 60. This same procedure is followed for feeder 3, so that at the third step No. 1, RI (where RI equals $M_1+M_2)+M_3$ is applied to adder 60 and subtracted from NC. This process continues on up to feeder No. 15 so that after the fifteenth such cycle, adder 60 contains NC-RI (where RI now equals $M_1+M_2+ \ldots M_{14})+M_{15}$, the X coordinate of feeder 15 on the fabric, i.e. the X coordinate of point C. (FIG. 2A).

While not the case with the present example of feeder 15, it may happen that some feeders on the machine 12 are actually knitting in a previous revolution from feeder 0, i.e. revolution 6 in FIG. 2A. In other words, in a thirty-six feed knitting machine knitting six colors, there are six feeders per course and six courses per revolution. The first six feeders are always knitting on the outermost course, the second group of six are knitting on the next outer course, and so on around the knitting machine. Under these circumstances, there may be some feeders which will be knitting on a previous revolution of the knitting machine from feeder 0. If this is the case, the calculation performed in adder 60 will result in a negative number. This causes the SAXA sign output line of the adder to become high. When this situation occurs, the number of needles (L) in the particular knitting machine being controlled must be added to the contents of adder 60 as described above, so that the adder count accurately reflects the X coordinate.

More particularly, the number L, which as noted above is a fixed number wired into a connector in section 24, is applied via a two input selector 68 to an adder 72. The selector 68 is enabled by the SAXA output of adder 60 and the L input is selected by a control signal CS1.

Adder 72 also receives the contents of adder 60 by way of a selector 74. Selector 74 delivers one of four inputs to adder 72 in accordance with its select control inputs SXCO and SXCI from section 28. When the selector is in its 10 state, the content of adder 60, is applied to adder 72. The contents of adder 72 is then loaded in parallel to an address register 76*a*. (The output of adder 72 as loaded into register 76*a* and thus the contents of that register, is defined as RX). At this point then, during step CS1, register 76*a* contains the coordinate of feeder 15 on the fabric; i.e. RX = 16.

The next step is to find the equivalent location of the feeder on the basic pattern, B, i.e. locate point A. This is accomplished by repetitively subtracting from the number RX in register 76*a*, the number X equal to the number of columns in the basic pattern. Since the specific feeder of interest may be located at a point on fabric quite far away in the X direction from the basic pattern B, it might take an excessive amount of time to return to the basic pattern in an iterative subtraction process involving just the subtraction of X. Accordingly, to save time, this subtraction is done in blocks.

More particularly, at control step CS2, the number RX in register 76*a*, which is applied to the 0 input of selector 68, is gated into adder 72. At the same time, the number X present at the zero input of selector 66 is transferred through adder 60 to selector 74, so that the adder 72 can receive −X, −2X or −8X depending on the selection inputs to the selector 74. When the selector 74 is in its 11 state during control steps CS2–CS11, adder 72 adds the number −8X to the contents of register 76*a*, i.e. 16, which is the X coordinate on the fabric of point C. If the difference number is positive, the content of adder 72 is loaded into register 76*a* and the process is repeated. In other words, the contents of that register, which are now 16−8X is applied to selector 68 and, during control step 3, 8X is again subtracted from that number in adder 72. If the difference is still a positive number, the contents of the adder are again loaded into register 76*a* and so on.

This subtraction process continues until the number in register 76*a* denotes an equivalent X coordinate of feeder 15 which is less than 8X away from the basic pattern. It may involve as many as 10 of the aforesaid subtraction operations, one at each of the control steps 2–11. The subtraction of 8X stops when the difference number in adder 72 becomes negative, causing its sign output line SAXB to become high. This SAXB signal is applied via a flip-flop 78 to change the state of selector 74 to 10 if the pattern being knitted is a normal repeat such as shown in FIG. 2A. Also, the system clock advances to step CS12.

Then, during the control steps, CS12–21, a second iterative subtraction process is performed which is the same as above described except that it involves the subtraction of X from the number contained in register 76*a*.

In the example shown in FIG. 2A, feeder 15 is already within 8X of the basic pattern. Accordingly, there is no subtraction carried out during control steps 2 to 11. Rather, the SAXB output steps the system clock immediately to control step 12. At this time, 16 is contained in register 76*a* and applied by way of the selector 68 to adder 72. At control step 12, the number 6 is subtracted from 16 so that the number in register 76*a* now denotes the X coordinate of a point E on the fabric. During the next control step 13, 6 is again subtracted from the number then in register 76*a* so that after step 13, the number in the register represents the X coordinate of Point F, equivalent to Point A on the basic pattern B. At this point, the SAXB output advances the system clock to skip control steps CS14 to 21.

While in the present example only two subtractions of X were required to reach the basic pattern location, in many cases the feeder of interest might be far away from the basic pattern so that as many as 10 control steps may be used for each iterative subtraction sequence. In any event, for a normal repeat, after control step 21, the register 76*a* always contains the equivalent location of the feeder of interest on the X axis of the basic pattern.

It the pattern being knitted is an X-direction mirror or chevron repeat of the basic pattern, as depicted in FIG. 2B or 2C, then selector 74 is placed on its 01 state so that 2X is deducted during the subtractions at control steps 12–21. This is because the basic pattern is really twice as wide since it includes the adjacent mirror image, i.e. it extends from X = 0 up to X = 5 and down to X = 0 again. Bear in mind, however, that in the case of a chevron-type repeat, the number X is defined as the number of columns in the basic pattern minus 1.

Also, in the case of mirror image or chevron repeats, the X address generator section must perform additional subtractions before loading the coordinate in register 76*a* to develop the proper X coordinate in the basic pattern. This is accomplished during control steps 22 to 24.

More specifically, at CS21, the contents of register 76*a* are again applied to adder 72 via selector 68 and added to −X from selector 74 which is now in its 10 state. This results in the subtraction of X from that number. If the SAXB line becomes high, indicating that the number is less than X, the coordinate calculation is complete. If the number is not less than X, there is a further subtraction of X in adder 72 at control step CS23.

For example, with reference to the mirror image pattern depicted in FIG. 2B, assume that by the end of control step 21, the X coordinate in register 76*a* coincides with point A, i.e. RX = 4. On step CS22, then, the number X, i.e. 6, is subtracted from that coordinate, resulting in a negative number. This produces a signal on the SAXB output line from adder 72 which indicates completion of X coordinate calculation. That is, the number 4 is the equivalent X coordinate of the feeder of interest on the basic pattern.

On the other hand, if point H, having a coordinate X = 7, is the one stepped to, the subtraction at step 22 yields +1, a positive number, so that X is subtracted again at step 23, yielding −5. Then, at step 24, a twos complement subtraction from zero step is performed by adder 72, yielding 0−(−5)−1 or 4, which is the correct equivalent X coordinate of point H on the basic pattern, i.e. point A. This subtraction is accomplished by means of a 00 select signal at the selector 74, which thereupon applies an inverted RX to the adder 72, the adder having no input from selector 68 in this case.

In the case of a chevron repeat in the X direction such as shown in FIG. 2C, the basic number subtracted in the foregoing sequence is reduced by one since, in that case, the number of columns is one more than X, i.e. 7. See FIG. 2C.

The next step is to transform the X coordinate in register 76*a* into a form suitable for addressing memory section 22. Before we make the transformation, however, we will describe the operation of the Y address generator section 26, since the X and Y coordinates are processed at the same time beginning at control step 25.

Referring now jointly to FIGS. 5 and 6, the Y address generator section 26 first must determine the location of feeder 15 in the Y direction on the fabric, i.e. locate the Y coordinate of point C. For this, section 26 contains a row count register 112. The contents of this register indicate the row or course on which feeder 0 is knitting at any given time. Since we are dealing with a 36 feed machine knitting six colors and since the pattern is 18 courses in height, feeder 0 will travel first on row 0, then on row 6, then on row 12, and finally on row 18, which is equivalent to row 0, on successive revolutions of the machine 12. Accordingly, the register 112 initially has a count of 0, after one revolution of the knitting machine it is incremented to 6 and after the second revolution, to 12 and, finally, after the third revolution when the basic pattern is completed, it is reset to 0.

In order to find the Y locations of feeders other than feeder 0, the section 26 includes counters 113 and 114 which both count by CCLB timing pulses from section 28. A CCLB pulse is generated after the end of each clock cycle to indicate that the controller has progressed to a memory address calculation for the next feeder. The output of counter 114 is applied to an EXCLUSIVE OR circuit 116, and to a register 108. The other input to circuit 116 is a number F equal to the number of feeders per course minus one (because the first feeder is numbered 0). This number F is one of the parameters which is stored in the memory section 22 and is routed to section 26. Counter 114 thus counts up to the number F, i.e. 5 in the present example, whereupon circuit 116 produces an output pulse which enables counter 113 to count the next CCLB pulse and also resets counter 114. Thus, counter 113 is incremented each time the machine moves from one course to the next on the knitted fabric.

The counts in register 112 and counter 113 are added together in an adder 117 and the sum defines the location in the Y direction of the feeder of interest on the fabric. In the case of the example depicted in FIG. 2A, feeder 15 is located on the third course of the seventh revolution of the knitting machine. Thus, the count in counter 112 is zero, while the count in counter 114 is 2. This is equivalent to the feeder being located on the third course of the first revolution, since each feeder knits the same part of the pattern every three machine revolutions.

The output of the counter 112 is also applied via a gate 118 clocked by CLB timing pulses to the memory section 22 to update the memory in case of a power failure.

As just mentioned, counter 112 is incremented by the number of courses per revolution until the basic pattern is completed, whereupon it is reset. This is accomplished by the output of selector 115 which is enabled by an ENSYD signal. The selector has two inputs, one of which is the contents of adder 117 and the other of which is a BSR-Y input from memory section 22. Selection between these two inputs is governed by a select signal from section 28 ENLNR. At the end of each machine revolution, selector 115 is enabled and in its 0 state. Upon the occurrence of an LDRC pulse from section 28 to counter 112, the number in adder 117 is applied to register 112, thereby adding to its content the count from counter 113, i.e. 6 in the example. After the content of register 112 reaches the total number of courses in the basic pattern, 18 in the present case, selector 115 is disabled and an LDRC signal is applied to the register so that a ZERO is loaded into it, thereby resetting it.

As discussed before, the particular feeder of interest may actually be knitting on a previous revolution from feeder 0. If this is the case, the coordinate in adder 117 must be reduced by the number of courses per revolution (C) in order to truly reflect the location of that feeder on the fabric. The number C is one of the parameters available in memory section 22 and it is present at one of the inputs of a selector 119. Selector 119 has four inputs RY, C, Y, and 2Y selected by signals SYB0 and SYB1 from section 28 for transmission to a second selector 122. Selector 122 has two selection lines SYC0 abnd SYC1, the latter of which inverts the selector input. The output of selector 122 is coupled to an adder 124 along with the output of a selector 126. Selector 126 has as its inputs the output of adder 117 and a quantity RY (to be defined). In the absence of a select signal SLRY, the selector 126 at CS1 applies the output of adder 117 to adder 124.

If the SAXA output line of adder 60 (FIG. 3) is high, indicating that the feeder being processed is in a previous revolution, selector 119 is placed in its 01 state, with the result that the number C is applied to selector 122. Selector 122 also receives an SYC1 signal, causing it to invert that number C before applying it to adder 124, thereby deducting from the coordinate at the output of adder 117.

The output of adder 124, which is then loaded into register **76*b* is defined as RY. Register 76*b* is actually an extension of register 76*a* (FIG. 3). If RY is positive, the determination of the Y coordinate is complete. In some cases, however, the subtraction of C for a feeder which is knitting in a previous revolution moves the coordinate for that feeder outside the basic pattern B. This produces a negative number in adder 124 which is reflected by a signal on the SAYB sign output line of the adder. In order to convert to a coordinate in the basic pattern, the basic pattern height Y is added to the contents of register 76*b* in the case of an ordinary repeat such as shown in FIG. 2A; the value 2Y is added in the case of a chevron or mirror repeat. More particularly, the SAYB signal applied by way of a flip flop 125 at step CS21 places selector 119 in its 10 state (for a normal repeat). Also, selector 122 receives a signal at its noninverting select line SYCO so that adder 124 adds Y to RY which it receives from register 76*b* by way of selector 126. The result is then loaded into register 76*b* and it constitutes the equivalent Y coordinate on the basic pattern of the feeder in question. For a mirror or chevron repeat, selector 119 selects 2Y for delivery to adder 124**.

Also, in the case of a mirror or chevron repeat in the Y direction, there is then additional processing of the coordinate during control steps CS22–24. This further processing of RY is exactly the same as was done above to RX and will not be repeated here. Suffice it to say that by the end of control step 24, the correct equivalent X and Y coordinates of the feeder on the basic pattern are stored in register 76.

At control steps CS25–36, the X and Y generator sections perform a linear transformation of the X and Y coordinates in register 76 to provide an address which, when applied to memory section 22, will retrieve color code data for the particular point on the fabric. Then, if the feeder at that fabric location was assigned to knit for the color code retrieved from memory, an instruction is issued to that feeder causing it to knit; otherwise, it does not knit.

The transformation performed during steps 25 to 36 is best illustrated by reference to FIG. 2A, along with FIGS. 5 and 6. As mentioned previously, the color data for the basic pattern B is stored in consecutive locations in memory section 22 stitch-by-stitch beginning with the bottom of column 0 of the pattern and ending at the top of column 5. The register 76 can be loaded and read out of in parallel, and its contents can also be shifted. By a series of load and shift operations in this register, the coordinates in that register reflecting the location of point A in the pattern are transformed into an address of the memory location containing the color data for point A.

The mathematical expression for the transformation is set forth in blocks **76*a*,*b* in FIGS. 4 and 6. For a normal or mirror repeat, coordinate RY is added to the product of Y and RX to obtain the correct memory address. On the other hand, for a chevron repeat, coordinate RY is added to the product of Y+1 and RX. We will apply this transformation to the coordinates of point A in FIG. 2A to thus illustrate that the transformation does indeed achieve the correct memory address for the point A and thus for the equivalent point C. In that example, RY=2, Y=18, RX=4. If these numbers are applied to the formula in block 76, the result is 74** which is the exact number of squares counting from the bottom of column 0 and scanning upward column-by-column to square A, bearing in mind that the first stitch has address 00.

The register 76 is clocked by CPRXY pulses from the control section 28. RX and RY are stored in register 76 at the end of CS24 and multiplied by a conventional add and shift sequence. Specifically, Y is applied to adder 124 through selectors 119 and 122. Also, RY is applied to that adder through selector 126. Thus, Y is added to RY repetitively RX times, $$\left.\begin{array}{l} RY\ (2) = 20 \\ 20 + 18 = 38 \\ \\ 38 + 18 = 56 \\ 56 + 18 = 72 \end{array}\right\} \quad RX = (4)$$

Finally, at step CS37 various elements in the X and Y generator sections are updated to prepare the system for the next clock cycle, i.e. for the next feeder. More particularly, M is added to the count in register 64 via adder 62 (FIGS. 3 and 4). Also, an output cycle is commenced as will be described.

The aforesaid sequence is repeated for each feeder in the machine. After all feeders have been processed, an ESN signal is generated in section 22 (FIG. 8) as will be described later, and further address calculation must wait until the next needle position of the knitting machine. As shown in FIGS. 3 and 4, the needle counter 52 is incremented, and then it is cleared if its content equals L, the number of needles on the knitting machine minus 1, i.e. if the knitting machine has completed a full revolution.

Also, following an ESN signal at time ESND, the row count in register 112 (FIG. 5) must be incremented if the needle count equals L. This is because the next needle movement will bring feeder 0 into alignment with needle 0, and feeder 0 will be directly above its position on the fabric the previous time the needle 0 was aligned with it. Specifically, the feeder 0 will be exactly C courses or rows above its previous position (in the present example six rows above). The row count is therefore added in adder 117 to the count in counter 113 (i.e. six in this example) and the sum is loaded back into register 112 via selector 115.

On the other hand, if feeder 0 has now advanced vertically by the height of the basic pattern, i.e. Y stitches, the row count in register 112 should be set to zero. That is, as feeder 0 begins to repeat the basic pattern, the row count must also repeat, beginning at a count of zero. Accordingly, the register 112 is cleared by applying a load pluse (LDRC) to it with the selector 115 disabled.

The flow diagram for the updating of the row counter is in the lower part of FIG. 6.

Referring briefly to FIG. 7, the memory address input section 22*a* includes a random access memory 140 addressed via an address selector 142. The selector 142 selects from three address sources as determined by its select inputs LOAD and SADI. The first of these is the register 76 which, as described above, contains the memory addresses of the colors corresponding to the feeder locations on the knitted fabric. The second is a counter load buffer (CLB) which is used during the load sequence and in updating certain information stored temporarily in the memory. The third address source is the tape reader 23 which generates memory addresses for storage of the information contained on the tape 21.

Data is loaded into and retrieved from the memory 140 in parallel. However, the data is retrieved from the tape 21 as a succession of bytes and to make efficient use of the memory, these bytes should in most cases be assembled into strings corresponding in length to the word length of the memory. Accordingly, this assembly is performed in a memory buffer register 144, a shift register whose output is supplied in parallel to the memory by way of a gate 146 that is enabled by an LDMEM signal.

More specifically, the register 144 is connected for recirculation through a selector 148. In the absence of an EXTD signal from the selector, the the register shifts rightward in response to CSRM pulses and transfers bits from its right-most stage around into its left-most stage. The EXTD signal causes the selector 148 to apply DTIN bits from the tape reader 23 to the left-most stage of the register 144 in place of the bits from the right-most stage.

To update the needle and row counts in the memory, input of needle and row count data from the memory 140 is initiated by an SADI signal to selector 142 (FIG. 7) at CS22. This data is obtained from memory in bits D16, D17. Then, at CS23, and SLD signal is applied to the selector 146 to apply bits from gates 56 and 118 (FIGS. 3 and 5) to the left two stages in the register 144. This needle and row count data is current in memory 140 in the event of power failure. When power is restored, the data can be fed to the BSR-X end and BSR-Y inputs of counter 52 (FIG. 3) and selector 115 (FIG. 5), respectively.

In the specific embodiment of the invention described herein, the memory 140 has 18 bit words. When knitting is to be performed in six colors, three bits are required for color encoding so that each memory location in that portion of the memory storing the pattern will contain six color bytes. On the other hand, if the fabric is to be knitted in four colors, only 2 bits are required for color encoding, in which case each memory location will contain nine color bytes. Included in the information loaded into the memory 140 from the tape 21 (FIG. 1) as an indication of whether the color bytes contain 2 bits or 3 bits.

FIG. 8 shows how the controller memory output section 22*b* develops the output signals that energize the selector solenoids at their respective knitting machine feeders. The section includes a control register 150 that holds various control parameters such as X, Y, F, C, the row count and needle count and the number of bits per color byte. The register 150 is a shift register that is loaded in parallel from the memory 140 in a series of memory output cycles prior to the commencement of knitting, with the information obtained from the memory being shifted internally in the register 150 to position it at the proper location therein.

Section 22*b* also includes a "scratch pad" memory 152 that stores consecutively information denoting the color codes for the pattern being knitted. Specifically, in consecutive addresses corresponding to the feeder numbers (FSO, FS1, etc.) are the codes, i.e. CC0, CC1, CC2, etc., for the colors that the feeders provide. Additionally, in the memory 152 are codes SF0, SF1, SF2, etc., identifying any feeders that are to be skipped in the particular knitting operation. As with the register 150, the scratch pad memory 152 is loaded in parallel from the memory 140 prior to commencement of the knitting operation. Addressing of the memory 140 and loading of the register 150 and memory 152 may, of course, be accomplished manually from conventional front panel switches. However, we prefer to accomplish this by means of a routine wired into the controller with addresses in the memories 140 and 152 being generated by a counter 153. It will be noted that the address developed by the counter 153 may include a fixed portion designating a section of the memory 140 and a variable, i.e. counted, portion reaching consecutive addresses within the memory 152. Incidentally, the count in counter 153 is applied to an EXCLUSIVE OR circuit 155 along with a number TF equal to the number of feeders in the machine. When the two numbers are equal, circuit 155 produces the ENS signal.

The memory 152 is addressed by way of a selector 154 having select inputs SSPO and SSPI which select among three inputs, to wit: counter 153, register 108 (FIG. 5) and panel switch 36 (FIGS. 1 and 8). The selector 154 is loaded by way of a selector 156. Data for the memory 152 may be applied to the selector 156 directly from the memory 140. However, since the word length in the memory 152 is substantially shorter than the word length in the memory 140, the data for the memory 152 is preferably in the form of bytes in the memory 140. In that case, the data for the memory 152 is first loaded into the register 150 in the form of word length blocks from the memory 140, with the individual bytes then being shifted into position for entry into the memory 152. Moreover, in that case, the counter 153 will include separate sections for addressing the memory 140 and the memory 152, with the address for the memory 140 being incremented each time the full memory 140 word has been loaded into the memory 152 and the address for the memory 152 being incremented as each byte is loaded into that memory. Data can also be applied to the selector 156 by panel switches $S_0$ to $S_5$ (FIGS. 1 and 8).

As described above, during operation of the knitting machine, a succession of memory addresses is generated in the color code address register 76 for the respective knitting machine feeders. Assuming that the address word has a length of 18 bits, the first 14 bits are used to address the memory 140 to locate the memory word therein containing the color information. The last four bits of the address identify the specific byte containing the information. Accordingly, as each memory address is developed in the register 76, the first 14 bits are applied to a memory 140 by way of the address selector 142 (FIG. 7) and the contents of the designated address are loaded into a pair of color registers 158 and 160.

The register 158 is organized with 6 bytes of 3 bits each and the register 160 with 9 bytes of 2 bits each. The registers for 158 and 160 are jointly addressed by bits $BS_0$ to $BS_3$ from the address register 76. If a four-color pattern is to be knitted, a resulting ENS4 signal from the control register 150 enables the output gate in the register 160. If a six-color pattern is to be knitted, the absence of an ENS4 signal enables the output gate in the register 158 by way of an inverter 162.

During operation of the knitting machine, the color code address in the address register 76 (FIG. 5) is applied to the memory 140 (FIG. 7) and the color registers 158 and 160 (FIG. 8) between control steps CS36 and CS37 and the contents of the designated memory location are loaded into registers 158 and 160 between those control steps and are applied to an OR circuit 166. Assuming that a six-color pattern is being knitted, the three selected bits in the color register 158 are applied to OR circuit 166. The OR circuit outputs to the 11 input of selector 154. At this time, a 11 control signal is applied to the selector 154 so that the selected color code addresses memory 152. The contents of that addressed location designates a feeder and this code is applied to a comparator 164 along with the content of register 108 (FIG. 5).

The content of register 108 is the number of the feeder for which the address in register 76 has been calculated. That is, the register 108 content designates the feeder for which a color byte from the register 158 has been applied to the memory 162. That feeder number is also applied to the comparator 164. If the feeder numbers from register 108 and memory 152 are the same, the comparator 164 provides an output signal. Through a suitable switching arrangement (not shown), the signal is used to set a flip-flop (not shown) associated with that feeder. If the two inputs to the comparator 164 do not match, that flip-flop is not set.

After the calculations for all the feeders in the knitting machine have been completed and the flip-flops associated with the respective feeders have been set or not set, the outputs of the flip-flops that have been set apply signals to the solenoids associated with the corresponding feeder selectors to make stitches at those locations on the fabric.

With further reference to FIG. 8, any particular feeder which is not supposed to knit during this operation of the knitting machine is identified in memory 152 as noted above. Once each selection sequence when selector 154 is in its 00 state, the output of a counter 165 addresses memory 152. The addressed location is applied to an EXCLUSIVE OR circuit 167 which also receives the output of counter 153. The output of circuit 167 is applied to a flip-flop 168. When the output of the memory is the same as the count in counter 153, flip-flop 168 is set and its resulting output inhibits comparator 164. Consequently, the flip-flop associated with that feeder is not set and the feeder does not knit, even though the feeder color matches the color retrieved from the register 158. The flip-flop 168 is then reset thereafter by the next CCLB pulse so as not to inhibit operation of the comparator 164 during its next comparison, unless, of course, the next feeder is also to be prevented from knitting. The output of circuit 167 is also applied to counter 165, causing it to count to the next skipped feeder in memory 152 and the process is repeated for that feeder.

As mentioned previously, it is possible to alter the design format of the pattern loaded into the controller from tape 21 by means of certain front panel controls. More specifically, the operator can change the colors selected for specific feeders by changing the codes in the scratch pad memory 152 obtained from register 150. For this, selector 154 is placed in its 01 state by application of a signal to its SSPl when the operator opens a door protecting the panel controls so that the memory 152 is addressed by the output of thumb wheel switch 36. The operator sets switch 36 on the color code whose feeder he desires to change. He also depresses one of the front panel switches $S_0$ to $S_5$ corresponding to the feeder he wishes to substitute or switch in the original design. At this time, the selector 156 is in its 0 state so that the feeder code generated by one of the switches $S_0$ to $S_5$ is substituted for the color code at the addressed location in memory 152.

Assume, for example, that a color design is composed of six vertical stripes colored red, yellow, green, cyan, black and white which repeats in sequence. Initially, the codes for the feeders handling these colors are loaded into memory 152 from memory 140 and occupy the memory addresses 0 to 5 therein. Assume now that the operator wishes to reverse the order of these stripes on the patterned fabric. He moves switch 36 to the A position. This addresses memory location 0. Thereupon, he depresses front panel switch S5 which substitutes for the feeder 0 code at that address a code corresponding to the feeder handling white, i.e. 5. Then the selector 36 is placed in its B position and the switch S4 is pushed which substitutes at address 1 the code for the feeder handling the color black in place of the original feeder 1 code. This process is repeated so that the memory 152 now contains the original feeder codes in reverse order. Now the knitting machine 12 will still knit a pattern composed of six stripes. However, the stripes will be arranged in reverse order from their original arrangement. The feeder serving red yarn will now knit at the locations originally programmed for the white feeder, and so on. If it is desired to return to the original color design, the operator presses the ORIGINAL button 42 on the front panel which initiates a load sequence from memory 140 which reloads the scratch pad memory 152 with the original feeder information from tape 21, just as though the system were starting up initially.

The operator can also manipulate front panel controls 44 and 46 to change the repeat format of the pattern for which the controller was originally programmed from tape 21. The switches 44 and 46 are wired to the locations in register 150 containing the repeat parameters. If the operator wishes to change a regular repeat in the X direction to a mirror type repeat, he turns switch 44 to its M position. Now the repeat parameter selected by switch 44 overrides the repeat parameter contained in register 150 and originally loaded into memory 140 from tape 21. Then if the operator wishes to return to the original repeat format, he may return switch 44 to its ORIGINAL position so that the original repeat information is again applied from register 150.

The display 35 illustrated in FIG. 1 designates the style number of the pattern on the tape 21 for which the controller 10 was originally programmed. The tape 21 contains this number in binary form and is stored in a register (not shown) within the controller whose content in turn controls the digital display. This number remains the same, even though the operator may change the pattern color or format by means of the various front panel controls as described above.

Desirably, the controller is provided with a voltage regulated battery pack which powers the controller for a time when power fails. Upon such failure, the batteries are cut in automatically and supply the controller until the current needle and row counts are stored in memory section 22. This is to ensure the counts in the memory will be correct when power is restored so that when applied to the sections 24 and 26, knitting will proceed where it left off.

Also, the system includes an "anticrawlback" feature which prevents the controller from sensing a needle count when the needle cylinder moves backwards under fabric tension when power fails. That is, under these circumstances, counter 52 may increment once when needle 0 moves backwards relative to feeder 0 and count again when it moves forward after power is restored. To avoid this, two optical sensors instead of one are mounted on the machine, both of which sense movement of the needles from one needle position to the next. The two sensors are operated in quadrature so that counter 52 receives an incrementing signal only when the needle cylinder moves forward.

It will be appreciated from the foregoing then that the subject controller can be used to control many present-day circular knitting machines. Since the controller stores the fabric pattern in terms of a much smaller basic pattern with repeat information and manipulates this information to generate the proper instructions for the knitting machine, its memory capacity can be relatively small. Furthermore, this feature allows the original pattern to be changed and manipulated to produce a multitude of different designs without completely reprogramming the apparatus or changing the setup of the knitting machine. Thus, the present system is extremely versatile and flexible, yet its cost is relatively low.

Still further advantages reside in the controller's ease of operation which allows the complete knitting system to be controlled by only moderately skilled personnel who can effect changes in the pattern fabric without extensive down-time of the knitting machine.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

We claim:

1. A controller for controlling a textile machine having stitching elements to make a patterned fabric comprising A. first means for storing data representing the stitch types comprising a subpart of the pattern on the fabric, B. means for determining the location of each stitch on the fabric, said location determining means including 1. first means for counting the number of stitches formed by the machine in a given row between an index location and the given stitch, and
2. second means for counting the number of stitches formed by the machine in a given column between an index location and the given stitch, C. means for repetitively reducing the count in at least one of the counting means by an integral multiple of the pattern subpart width if the deduction is from the first counting means count and of the pattern subpart height if the deduction is from the second counting means count until the remaining count is less than the number of stitches in the corresponding direction of the pattern subpart so that each said stitch location on the fabric is related to an equivalent location in the pattern subpart, D. means for retrieving from the storage means data representing the selected stitch type for said equivalent location, and E. output means responsive to said retrieved data for causing textile machine stitching elements to form the selected stitch type at said determined location on the fabric.

2. The controller defined in claim 1 wherein

A. the storage means stores the stitch type data for consecutive stitch locations in the pattern subpart at consecutive locations in the storage means, and B. the data retrieving means include means for converting the equivalent coordinates to a form determinative of the number of consecutive storage means locations between the first such storage means location and the storage means location containing the stitch type data from the equivalent coordinate location.

3. The controller defined in claim 1 wherein the output means comprise

A. second means for storing data associating the stitch types and the machine stitching elements which are supposed to form them, B. means for applying the data retrieved from the first storage means to address the second storing means, and C. means responsive to the data supplied from the second storing means for directing each stitching element to stitch or not stitch, depending on whether or not there is a relationship between the identity of that element and the data retrieved from the second storing means.

4. A controller for a knitting machine having a plurality of feeders arranged to knit a plurality of colors, said machine being arranged to knit a patterned fabric composed of a basic pattern and repeats of the basic pattern, said controller comprising A. a memory for storing color data representing the color only of each stitch in the basic pattern, B. means for determining the location of each machine feeder on the patterned fabric, C. means for relating each said feeder location to an equivalent location on the basic pattern, D. means for applying the coordinates of the equivalent locations to address the memory to retrieve the color data for the equivalent locations, said applying means comprising 1. storage means for storing information designating which machine feeders knit which colors in the basic pattern,
2. means for relating the contents of the memory designating the color of each stitch in the basic pattern to the contents of the data storing means designating which feeders are to knit which colors, and
3. means for developing an output to the data responsive means indicating a match so that the data responsive means instruct that particular feeder to knit and when there is no such match, so that the data responsive means do not instruct that particular feeder to knit, and E. means responsive to the color data from the memory for controlling the feeders at the determined locations on the fabric so that they knit a repeat of the basic pattern.

5. The controller defined in claim 4

A. wherein the memory also stores parameters which control the format in which the basic pattern is repeated on the fabric, and B. further including means for changing the repeat information from the memory so as to change the repeat format on the fabric.

6. The controller defined in claim 4 wherein

A. the memory also stores data reflecting which feeders are supposed to knit which colors, and B. the address applying means address the feeder data locations in memory with the color data retrieved from the memory.

7. The controller defined in claim 6 and further including means for changing the feeder data from the memory so as to change the locations on the basic pattern that the feeders knit to thereby alter the color arrangement of the patterned fabric.

8. The controller defined in claim 4 wherein the location determining means include A. means for counting the number of stitch columns between each machine feeder and an index feeder on the machine, B. means for subtracting from that count the number of stitch columns between each selected feeder and the index feeder, and C. means for counting the number of stitch rows between each selected feeder and the index feeder.

9. The controller defined in claim 8 and further including

A. means for detecting that a selected machine feeder is knitting on a previous revolution on the fabric pattern, and B. means responsive to the detecting means for 1. adding to the count in the first counting means a number representing the number of cylinder needles in the knitting machine, and
2. means for subtracting from the second counting means a number representing the number of courses per revolution of the knitting machine.

10. The controller defined in claim 9 and further including

A. means for sensing that said subtraction of the number of courses per revolution of the machine yields a stitch location which is outside the basic pattern, and B. means responsive to the sensing means for adding to the number in the second counting means a number equal to the number of rows in the basic pattern.

11. The controller defined in claim 4 wherein the location relating means is comprised of A. first iterative subtraction means for subtracting from the X coordinant of each said location on the fabric a number equal to an even multiple of the basic pattern width until a point on the basic pattern is reached which corresponds to said equivalent location, and B. second iterative subtraction means for subtracting from the Y coordinant of each said location on the fabric a number equal to an even multiple of the basic patent height until a point on the basic pattern is reached which corresponds to said equivalent location.

12. The controller defined in claim 4 wherein the coordinant supplying means include A. means for multiplying the number of stitch rows in the basic pattern by the X coordinant of each said equivalent location on the basic pattern, and B. means for adding to that product the Y coordinant of each said equivalent location on the basic pattern.

* * * * *